US012344440B2

(12) United States Patent
Gonzalez Colls

(10) Patent No.: US 12,344,440 B2
(45) Date of Patent: Jul. 1, 2025

(54) LIQUID-PRODUCT DISPENSING CONTAINER

(71) Applicants: Josefa Colls Llobet, Girona (ES); Isabel Gonzalez Colls, Girona (ES)

(72) Inventor: Isabel Gonzalez Colls, Girona (ES)

( * ) Notice: Subject to any disclaimer, the term of this patent is extended or adjusted under 35 U.S.C. 154(b) by 0 days.

(21) Appl. No.: 18/402,786

(22) Filed: Jan. 3, 2024

(65) Prior Publication Data

US 2025/0162765 A1 May 22, 2025

(30) Foreign Application Priority Data

Nov. 16, 2023 (ES) ..... ES202332038U

(51) Int. Cl.

| | |
|---|---|
| ***B65D 39/06*** | (2006.01) |
| ***B65D 43/06*** | (2006.01) |
| *B65D 43/02* | (2006.01) |

(52) U.S. Cl.

CPC ..... *B65D 39/06* (2013.01); *B65D 43/06* (2013.01); *B65D 43/0231* (2013.01); *B65D 2543/00564* (2013.01)

(58) Field of Classification Search

CPC ..... B65D 47/2031; B65D 2543/00046; B65D 39/06; B65D 43/06; B65D 43/0231; B65D 2543/00564; A01K 7/00; A47G 19/2266

See application file for complete search history.

(56) References Cited

U.S. PATENT DOCUMENTS

| | | | | |
|---|---|---|---|---|
| 4,915,268 | A * | 4/1990 | Lay | B65D 47/0809 220/837 |
| 5,553,957 | A * | 9/1996 | Dornbusch | A45D 34/041 401/209 |
| 8,939,669 | B2 * | 1/2015 | Le | A45D 34/04 401/216 |
| 2016/0016706 | A1 * | 1/2016 | Rognard | B65D 47/0838 222/545 |
| 2017/0095098 | A1 * | 4/2017 | Uitbeijerse | B65D 47/2031 |
| 2018/0265269 | A1 * | 9/2018 | Wilford | B65D 75/22 |

* cited by examiner

*Primary Examiner* — Shawn M Braden

(74) *Attorney, Agent, or Firm* — Patenting Consulting Group; Roberto J Rios

(57) ABSTRACT

A liquid-product dispensing container includes a body containing the liquid product to be dispensed, which has a tapered neck on top that is complemented by a closing cap. The container includes a gasket for the neck of the container, having a configuration in the form of a spherical sector or dome that extends downwards into a tubular neck and snugly attaches to the inside of the tapered neck of the container, so that the product contained therein is capable of flowing through the tubular neck when the container is tilted, the spherical dome including small holes for the controlled outlet of the product. The cap includes on its lower face a gasket ring that comes in contact with the holes in the spherical dome during the closing maneuvers of the container, preventing the product from accidentally coming out when the container is tilted with its cap attached to it.

6 Claims, 2 Drawing Sheets

LIQUID-PRODUCT DISPENSING CONTAINER

TECHNICAL FIELD

The present invention relates to a liquid-product dispensing container, which has been specially designed for the candy industry, although it is equally applicable in other areas where similar performance is required.

The object of the invention is to provide a hygienic and secure liquid candy dispensing device for children's use, which allows for optimal tasting of the product contained therein.

BACKGROUND OF THE INVENTION

In the preferred field of practical application of the invention, liquid candy dispensing containers are known, which consist of a main body having a diverse geometry, whether cylindrical, oval, rectangular, etc., that ends in a tapered neck closed with a cap, such that a seat in which a spherical body fits with a certain adjustment is defined in the tapered neck. In this way, the adjustment provides a clearance that allows it to be rotated but prevents it from coming out of said seat, in a manner analogous to other types of containers commonly called "roll-on", such that the user, after removing the cap, can consume the product contained in the container by rolling the spherical body on their tongue, as said spherical body is impregnated with the liquid candy in question.

Containers of this type have been on the market for some time, widely accepted by children, although it has been observed how said containers present a problem in which the following aspects should be highlighted:

- Firstly, and as the biggest problem, the essential maneuver of rotating the spherical body of the container on the user's tongue so that the surface impregnated with liquid candy is externally accessible means that sometimes the container has to move an excessive distance along the user's tongue, which may cause choking and/or gagging.
- As a result of the latter and given that the taste buds responsible for transmitting sweet flavors are concentrated on the distal and free end of the tongue, much of the product is not applied to this area of the tongue, but rather further back, meaning that the product is not tasted properly.

DESCRIPTION OF THE INVENTION

The liquid-product dispensing container that is disclosed completely and satisfactorily solves the aforementioned problem, based on a simple but effective solution, maintaining a very similar appearance to the type of containers described above, widely accepted by children, but offering a much more secure structuring in its use.

To this end, and more specifically, based on the conventional structuring of containers of this type, involving a body containing the liquid product to be dispensed, which has a tapered neck on top that is complemented by a closing cap, the invention focusses its features on the fact that, in replacing the spherical body, the device includes a gasket part for the neck of the container, which has a configuration in the form of a spherical sector or dome that extends downwards into a tubular neck and snugly attaches to the inside of the tapered neck of the container, so that the product contained therein is capable of flowing through said tubular neck when the container is tilted, the spherical dome including small holes for the controlled outlet of said product.

According to another feature of the invention, the cap, which will preferably be a screw cap, will include on its lower face a gasket ring that comes in contact with the holes in the spherical dome during the closing maneuvers of the container, preventing the product from accidentally coming out when the container is tilted with its cap attached to same.

In this way, and as mentioned previously, a container is achieved with a very similar appearance to "roll-on" candy dispensing containers, since the spherical dome that includes its tapered neck has a very similar configuration in the areas where it is visible to the user, but nevertheless, its use is much safer and optimal, since it does not require moving the device along the user's tongue. To this it is important to add that it also improves tasting of the product, since the taste buds that detect sweet flavors are concentrated on the distal and free end of the tongue, on which the spherical dome of the container would be applied.

BRIEF DESCRIPTION OF THE DRAWINGS

As a complement to the description that will be provided herein, and for the purpose of helping to make the features of the invention more readily understandable, according to a preferred practical exemplary embodiment thereof, said description is accompanied by a set of drawings constituting an integral part thereof in which, by way of illustration and not limitation, the following is represented.

PREFERRED EMBODIMENT OF THE INVENTION

Figure 1:
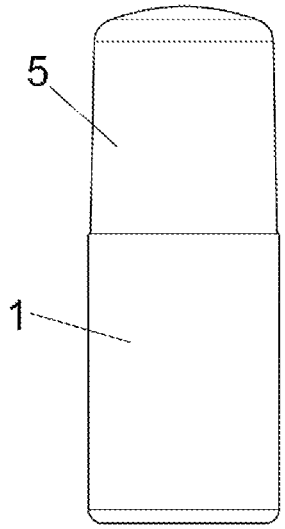
FIG. 1 shows a front elevation view of a liquid-product dispensing container made according to the object of the present invention.
Figure 2:
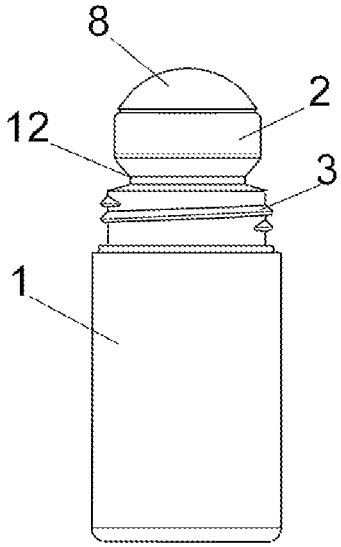
FIG. 2 shows a view similar to FIG. 1, but in which the container appears to be devoid of its upper closing cap.
Figure 3:
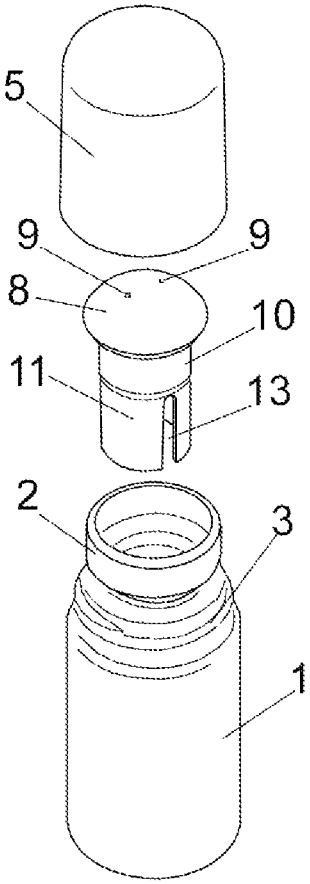
FIG. 3 shows an exploded perspective view of the assembly of FIG. 1.
Figure 4:
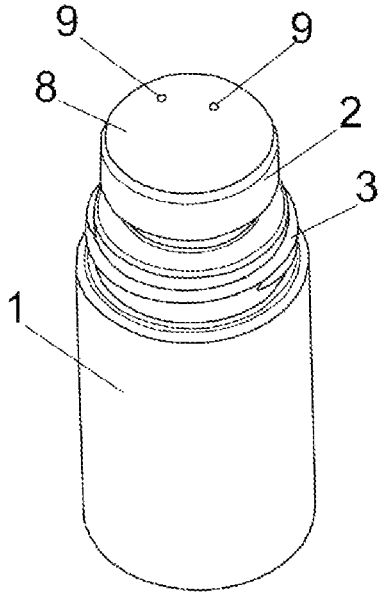
FIG. 4 shows a perspective view of the assembly of FIG. 2.

In view of the figures shown, it can be seen how the liquid-product dispensing container proposed by the invention is made up of a main body (1), intended to contain therein the liquid product to be consumed as it is dispensed, which in the chosen exemplary embodiment adopts an essentially cylindrical configuration, although it could adopt other configurations in accordance with other design lines without affecting the essence of the invention.

In either case, the main body (1) includes a tapered neck (2) on top having an external thread (3) complementary to an internal thread (4) of a closing cap (5).

Figure 5:
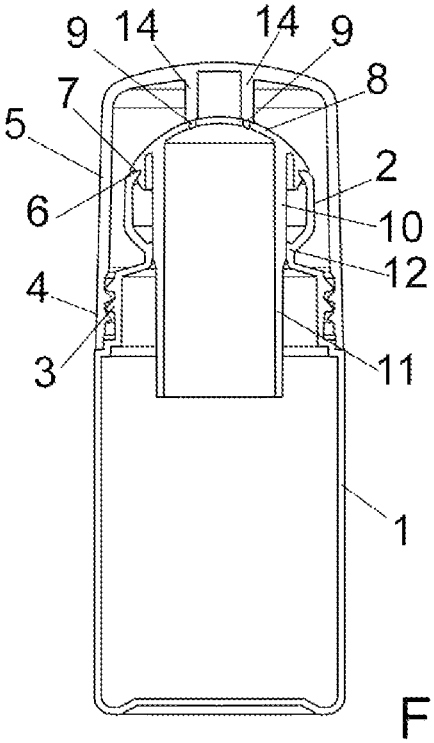
FIG. 5 lastly shows an elevation view and diametric section of the assembly of FIG. 1.

As shown in FIG. 5, the tapered neck (2) ends at its upper end determining the corresponding mouth in an inward bend (6) in which a perimeter slot (7) provided in a gasket-dispenser (8) fits having a configuration in the form of a spherical dome, equipped with one or more holes (9) (two holes in the chosen exemplary embodiment), which allow the product contained inside the main body (1) of the container to flow in a controlled manner on the user's tongue at its free end, once the closing cap (5) has been removed.

According to another feature of the invention, and as also shown in FIG. 5, for better attachment and stability of the gasket-dispenser (8), said gasket-dispenser extends downwards into a tubular neck (10), having a circular section, the outer diameter of which is identical to the inner diameter of a perimeter narrowing (12) provided in the neck (2) so that it fits snugly, said tubular neck (10) extending below said narrowing in a segment (11) of lesser thickness that, so as to not hinder the flow of the product contained in the container through the gasket-dispenser (8), will include one or more longitudinal slots (13) that extend to the area close to where said neck widens, thus allowing the consumption of the contents of the container to be optimized.

Finally, it must be mentioned that the cap (5) will include on the inner face of its upper base a gasket ring (14) that comes in contact with the holes (9) in the spherical dome during the closing maneuvers of the cap (5), closing these holes and therefore preventing the product from accidentally coming out when the container is tilted with its cap attached to same.

In this way, a secure, efficient and hygienic container is achieved, ideal for consuming liquid candy, although, as previously noted, the container can be used to dispense other liquid products that require similar performance.

The invention claimed is:

1. A liquid-product dispensing container made up of a main body (1) configured to contain therein the liquid product to be consumed as it is dispensed, which includes a tapered neck (2) on top having an external thread (3) complementary to an internal thread (4) of a closing cap (5), said liquid-product dispensing container comprising:

a gasket-dispenser (8) configured to be attached to the tapered neck (2), and having a configuration in the form of a spherical dome extending downwards into a cylindrical tubular neck (10) that is inserted inside of the tapered neck (2), said spherical dome being equipped with at least one hole (9) for the outlet of the product to be dispensed.

2. The liquid-product dispensing container according to claim 1, wherein the tapered neck (2) ends at an upper end in an inward bend (6) that fits into a perimeter slot (7) provided in the spherical dome of the gasket-dispenser (8), said spherical dome extends downwards into the cylindrical tubular neck (10) with an outer diameter identical to an inner diameter of a perimeter narrowing (12) provided in the tapered neck (2) of the main body (1) of the container.

3. The liquid-product dispensing container according to claim 1, wherein the cylindrical tubular neck (10) extends below a perimeter narrowing (12) of the tapered neck (2) of the main body (1) of the container in a segment (11) of lesser thickness that includes at least one longitudinal slot (13).

4. The liquid-product dispensing container according to claim 2, wherein the cylindrical tubular neck (10) extends below the perimeter narrowing (12) of the tapered neck (2) of the main body (1) of the container in a segment (11) of lesser thickness that includes at least one longitudinal slot (13).

5. The liquid-product dispensing container according to claim 1, wherein the closing cap (5) includes a gasket ring (14) in correspondence with an inner face of an upper base of said closing cap (5), so that in a closed position of said closing cap (5), the gasket ring (14) serves a gasket for the at least one hole (9) in the spherical dome of the gasket-dispenser (8).

6. The liquid-product dispensing container according to claim 1, wherein said gasket- dispenser (8) does not include a spherical body.

* * * * *